US008112910B2

(12) United States Patent
Herber

(10) Patent No.: US 8,112,910 B2
(45) Date of Patent: Feb. 14, 2012

(54) SHOE WRAP AND SYSTEM

(76) Inventor: Kate Herber, San Diego, CA (US)

( * ) Notice: Subject to any disclaimer, the term of this patent is extended or adjusted under 35 U.S.C. 154(b) by 913 days.

(21) Appl. No.: 12/110,711

(22) Filed: Apr. 28, 2008

(65) Prior Publication Data

US 2009/0265959 A1 Oct. 29, 2009

(51) Int. Cl.
*A43B 5/18* (2006.01)

(52) U.S. Cl. ..... 36/135; 36/7.2; 36/129

(58) Field of Classification Search ..... 36/135, 36/7.2, 62, 7.4, 7.7, 129
See application file for complete search history.

(56) References Cited

U.S. PATENT DOCUMENTS

| | | | | | |
|---|---|---|---|---|---|
| 2,076,316 | A | * | 4/1937 | Beals, Jr. | 36/7.5 |
| 4,069,599 | A | | 1/1978 | Alegria | |
| 4,251,932 | A | * | 2/1981 | Love | 36/7.4 |
| 4,484,398 | A | | 11/1984 | Goodwin et al. | |
| 4,638,574 | A | | 1/1987 | Roda | |
| 5,172,496 | A | | 12/1992 | Vemi | |
| 5,367,794 | A | * | 11/1994 | Adelstein et al. | 36/135 |
| 5,666,746 | A | | 9/1997 | Pollard | |
| 5,722,189 | A | | 3/1998 | Johnson | |
| 5,996,258 | A | | 12/1999 | Simmons | |
| 6,061,931 | A | * | 5/2000 | Kaneko | 36/129 |
| 2002/0157279 | A1 | * | 10/2002 | Matsuura et al. | 36/25 R |
| 2003/0159315 | A1 | * | 8/2003 | Willis | 36/135 |
| 2004/0035026 | A1 | * | 2/2004 | Foster, Jr. | 36/135 |

* cited by examiner

*Primary Examiner* — Ted Kavanaugh
(74) *Attorney, Agent, or Firm* — Dale J. Ream

(57) ABSTRACT

A shoe system includes a shoe having a sole with forward and rearward portions, the forward portion having opposed sides and including a plurality of spike elements and the rearward portion being void of spike elements. The shoe system includes a cover configured to span between the opposed sides of the forward portion lowerly adjacent the spike elements; the cover having opposed sides and including a lower layer, an intermediate layer, and an upper layer. The lower, intermediate, and upper layers are removably coupled to the shoe. The lower layer is constructed of flooring-friendly material, the intermediate layer is constructed of a yielding material, and the upper member is constructed of a porous material. The spike elements interact with the upper layer and at least a portion of the intermediate layer when the cover is lowerly adjacent the spike elements.

10 Claims, 6 Drawing Sheets

SHOE WRAP AND SYSTEM

BACKGROUND OF THE INVENTION

This invention relates generally to shoe covers and, more particularly, to a shoe wrap and system for covering spikes on a track shoe so as to prevent damage to both the spikes and surface being walked on.

Participants in the sport of track often find it necessary or prudent to change their shoes between events. Such frequent changes are often because the sharp spikes of the track shoes may damage surfaces upon which the wearer may traverse, such as wood, tile, or even cement surfaces. Further, walking on surfaces other than the track may cause damage to the spikes themselves or simply result in a conglomeration of foreign substances within the spikes such as mud and grass. In addition, it is generally difficult to walk on normal surfaces with shoes Various devices have been proposed in the art for covering the spikes of a track shoe or for protecting surfaces walked on by a wearer of track shoes. Although assumably effective for their intended purposes, the existing devices do not provide a removable sole for protecting surfaces from the spikes of a track shoe that is held in place by hook and loop fasteners so as to be quick to attach or detach.

Therefore, it would be desirable to have a shoe wrap for covering the spikes of a track shoe so that a surface being walked on is not damaged. Further, it would be desirable to have a shoe wrap for track shoes that is easy to attach and detach and compact to store when not in use. In addition, it would be desirable to have a shoe wrap having multiple layers and that is useful regardless of the pattern of spikes on the shoe.

SUMMARY OF THE INVENTION

Therefore, a shoe system according to the present invention includes a shoe having a sole with forward and rearward portions, the forward portion having opposed sides and including a plurality of spike elements and the rearward portion being void of spike elements. The shoe system includes a cover configured to span between the opposed sides of the forward portion lowerly adjacent the spike elements, the cover having opposed sides and including a lower layer, an intermediate layer, and an upper layer. The lower, intermediate, and upper layers are removably coupled to the shoe. The lower layer is constructed of flooring-friendly material, the intermediate layer is constructed of a yielding material, and the upper member is constructed of a porous material. The spike elements interact with the upper layer and at least a portion of the intermediate layer when the cover is lowerly adjacent the spike elements. Alternatively, the cover may include only a lower layer and an upper layer. The lower layer of the cover may include a rear section having a sloped configuration such that a user may walk smoothly with the cover attached to his shoes.

Therefore, a general object of this invention is to provide a shoe wrap and system for protecting a flooring surface from the negative impact of spikes on a spiked shoe.

Another object of this invention is to provide a shoe wrap and system, as aforesaid, that is useful and effective regardless of the number or pattern of spikes on the shoe.

Still another object of this invention is to provide a shoe wrap and system, as aforesaid, that is easy and quick to attach to or detach from a spiked shoe.

Yet another object of this invention is to provide a shoe wrap and system, as aforesaid, including a lower layer having a flooring-friendly material, an intermediate layer having a yielding material, and an upper layer having a porous material.

A further object of this invention is to provide a shoe wrap and system, as aforesaid, having a strap with hook and loop fasteners for selectively coupling the shoe wrap to a shoe.

Another object of this invention is to provide a shoe wrap and system that allows a user to walk smoothly when the shoe wrap is attached to a spiked shoe.

A still further object of this invention is to provide a shoe wrap and system, as aforesaid, that is economical to produce, compact to store when not in use, and easy to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A shoe system will now be described in detail with reference to FIG. 1 through FIG. 6*b* of the accompanying drawings. More particularly, the shoe system 100 includes a shoe 110 and a wrap 120.

Figure 5A:
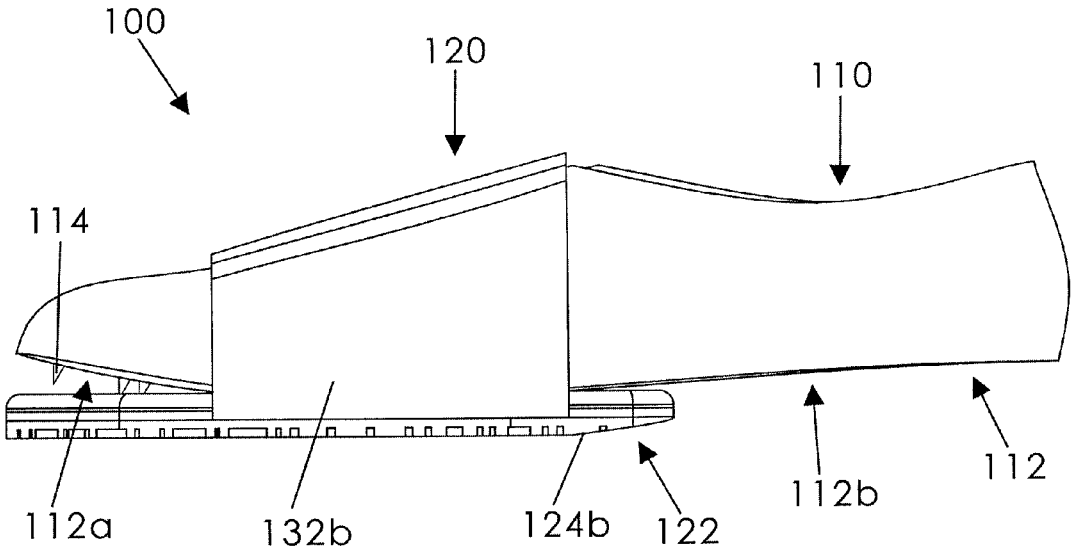
FIG. 5*a* is side view of the shoe wrap as in FIG. 1 in use with a shoe.

As shown in FIG. 5*a,* the shoe 110 has a sole 112 with forward and rearward portions 112*a,* 112*b.* The forward portion 112*a* has opposed sides 113*a,* 113*b* (FIG. 5*b*) and includes a plurality of spike elements 114 (e.g., removably or permanently attached track spikes). The rearward portion 112*b* is void of spike elements 114. In one embodiment, the forward portion 112*a* extends beneath the ball of a wearer's foot. The shoe 110 may, for example, be a track running shoe. The sole 112 includes a front end and an opposed rear end. The forward Portion 112*a* of the sole 112 is integrity connected together with the reaward portion 112*b* generally at a midpoint between the sole front and the rear end.

Figure 1:
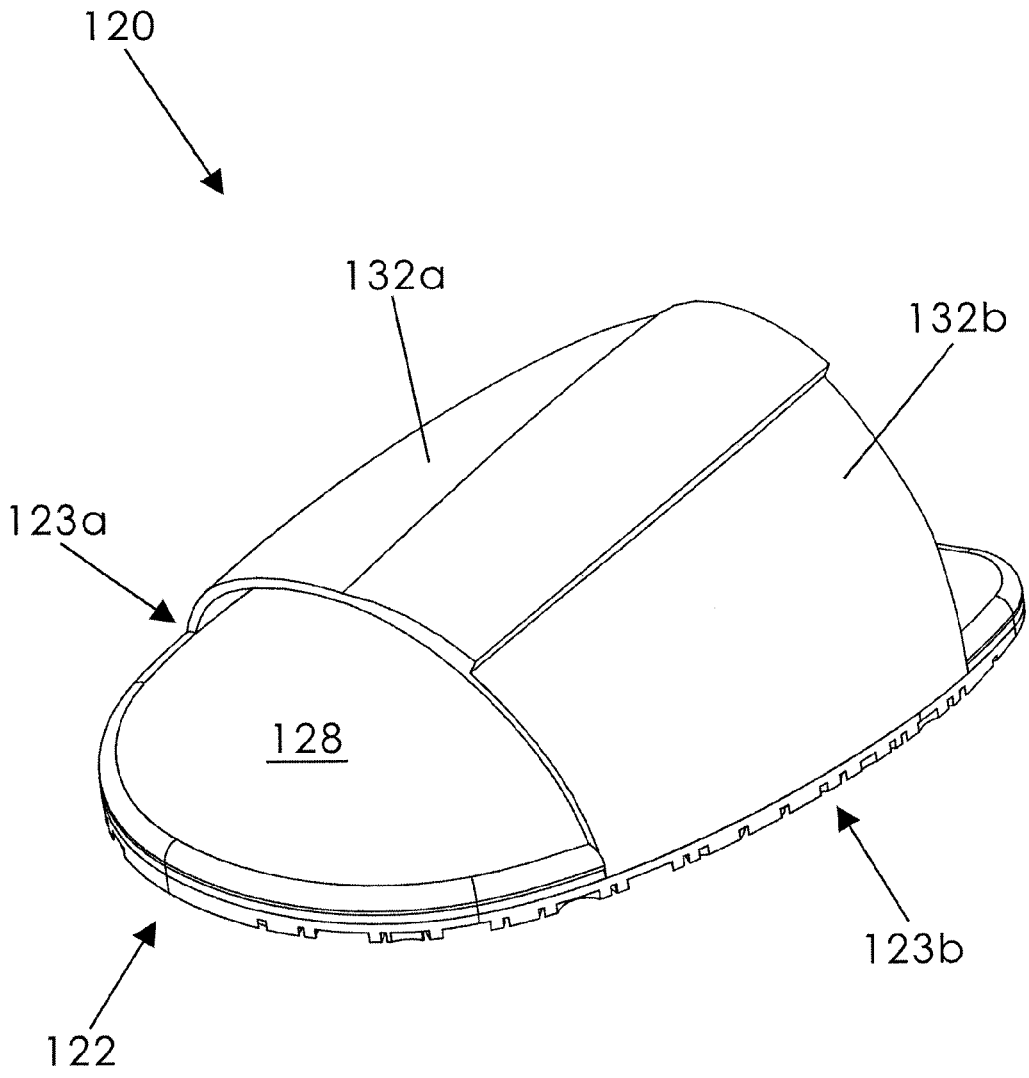
FIG. 1 is a perspective view of a shoe wrap according to a preferred embodiment of the present invention with a strap in a coupled configuration.
Figure 2:
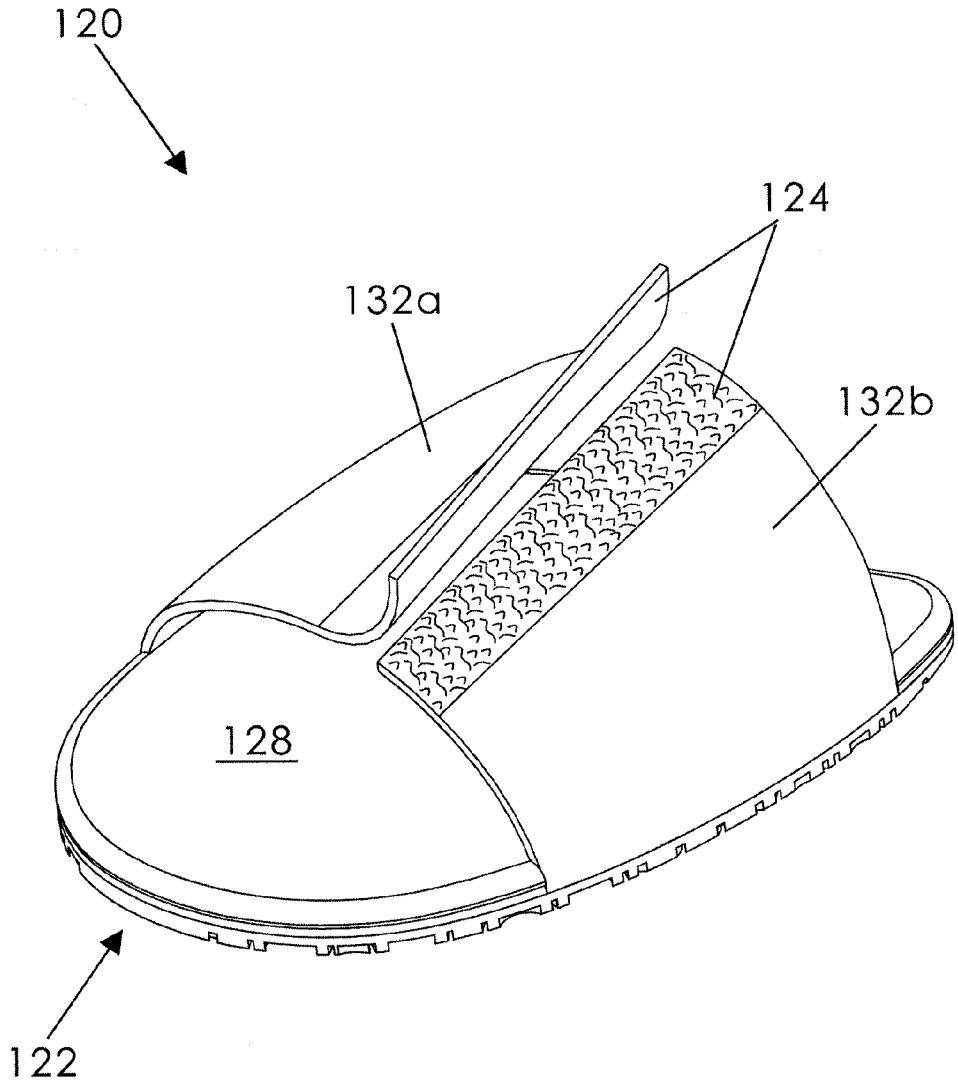
FIG. 2 is another perspective view of the shoe wrap as in FIG. 1 with the strap in a released configuration.
Figure 3:
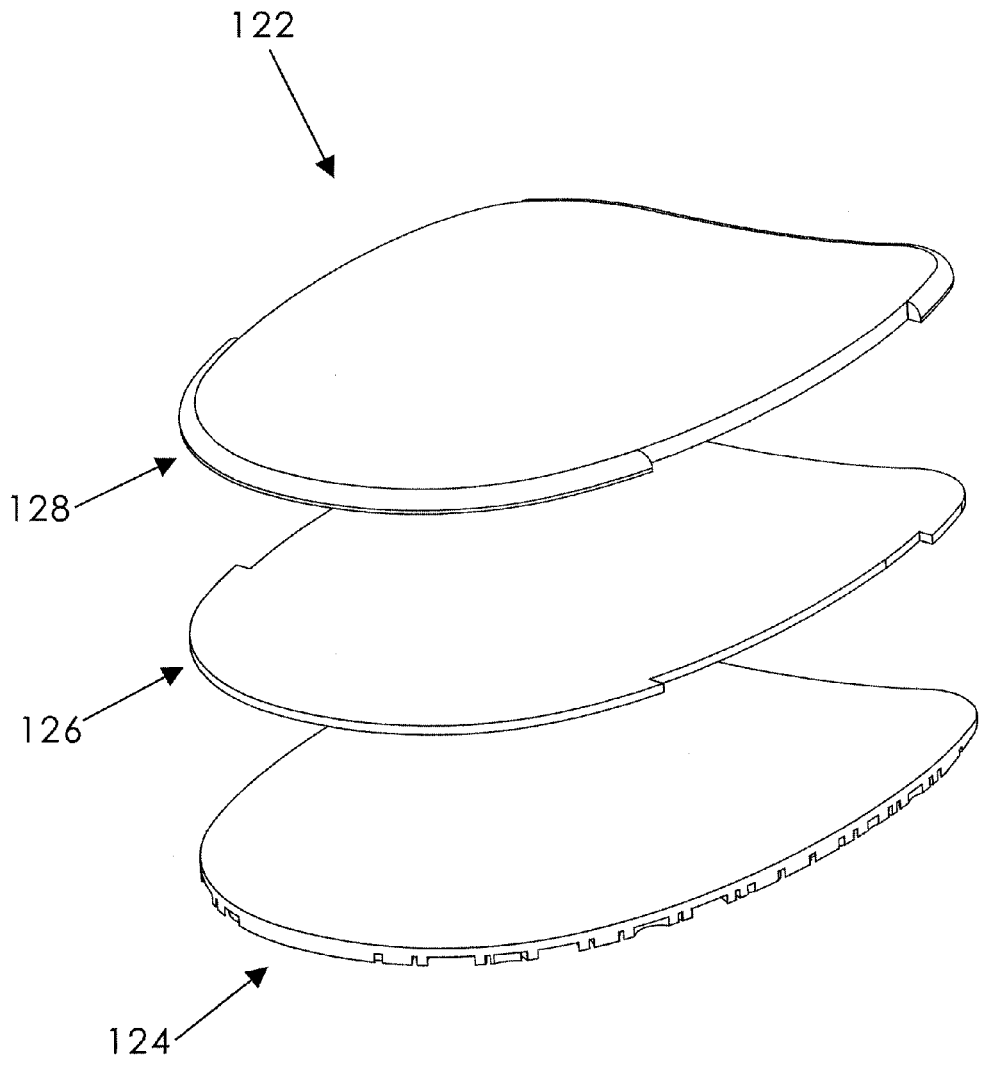
FIG. 3 is an exploded view of the cover of the shoe wrap as in FIG. 1.
Figure 4B:
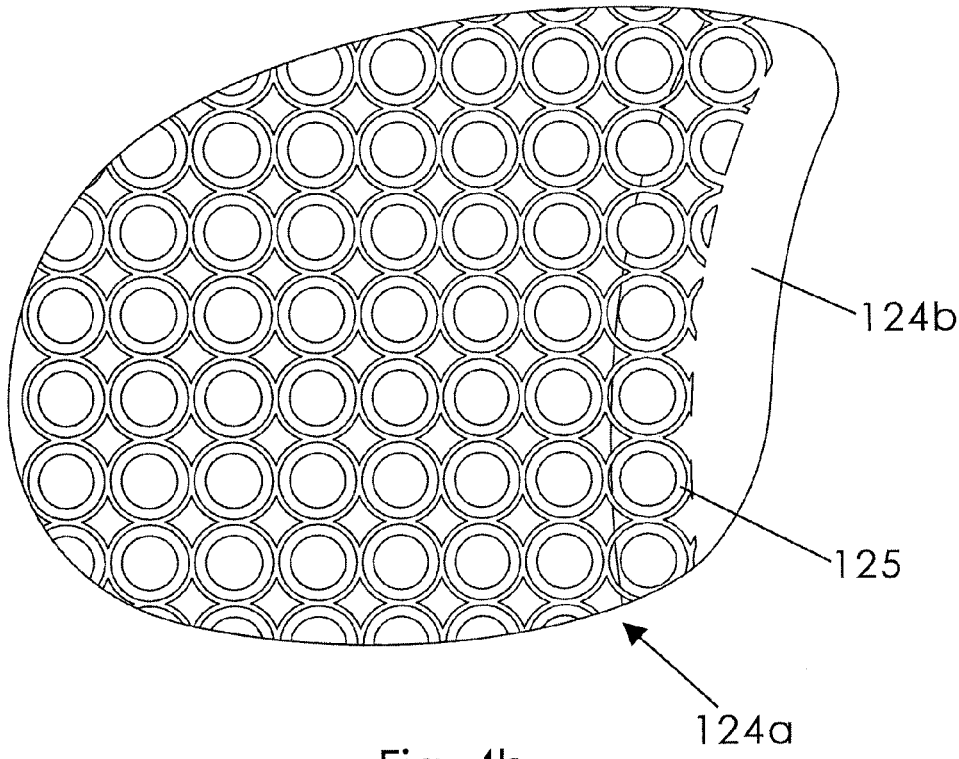
FIG. 4*b* is bottom view of the cover as in FIG. 4*a;*
Figure 5B:
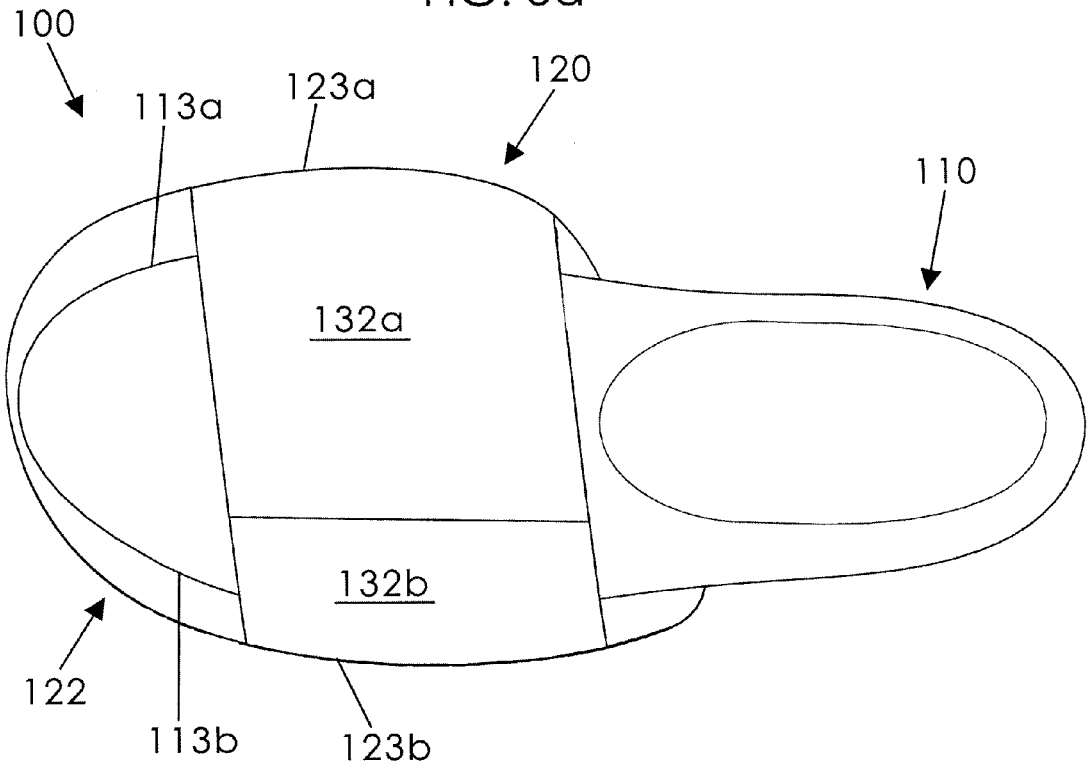
FIG. 5*b* is a top view of the shoe wrap as in FIG. 5*a;*

As shown in FIGS. 1, 5*a*, and 5*b*, the wrap 120 includes a cover 122 configured to span between the opposed sides 113*a*, 113*b* of the shoe sole 112 when lowerly adjacent the spike elements 114. The cover 122 has opposed sides 123*a*, 123*b* and includes a lower layer 124, an intermediate layer 126, and an upper layer 128 (FIG. 3). The lower layer 124 is constructed of floor-friendly material, the intermediate layer 126 is constructed of yielding material, and the upper layer 128 is constructed of porous material. The lower layer 124 may include a ground-contact face 124*a* having a plurality of treads 125, as shown in FIG. 4*b*. The lower, intermediate, and upper layers extend between the sole front end and the midpoint between said front and rear ends.

Figure 4A:
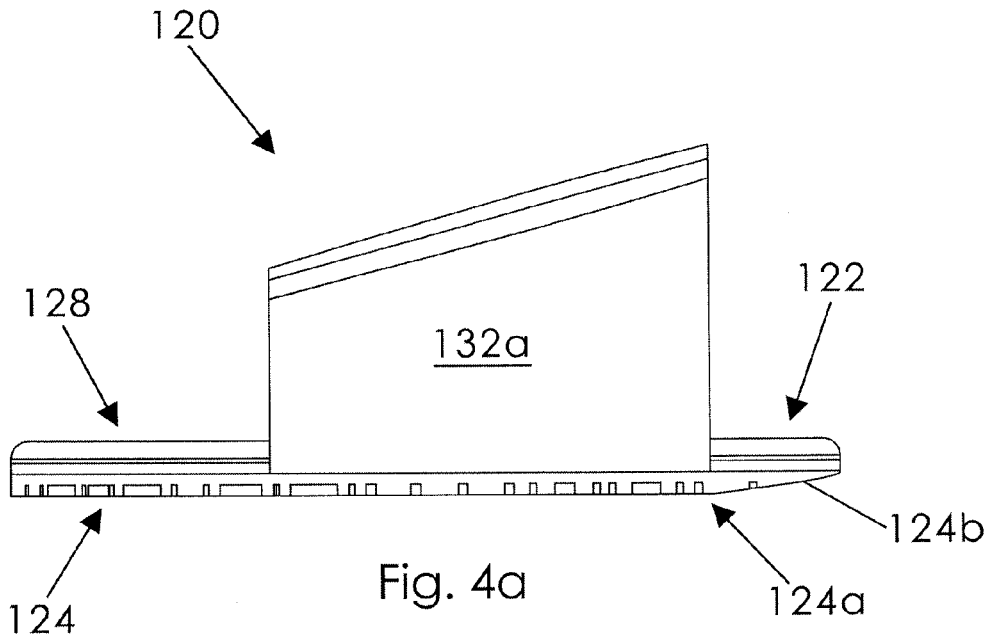
FIG. 4*a* is a side view of the cover as in FIG. 1.

A rear section 124*b* of the ground contact face 124*a* includes a sloped configuration (FIGS. 4*a* and 4*b*). More particularly, the rear section 124*b* is angled upwardly from the treads 125 toward the intermediate layer 126 such that the smoothness of walking while the cover 122 is attached to a shoe 110 is enhanced (FIG. 5*a*). The ground contact face 124*a* is situated lowerly adjacent the sole midpoint between the sole front and rear ends.

A flooring-friendly material is any material that does not scratch, mar, or otherwise damage flooring such as wood, metal, carpet, asphalt, rubber-coated running track surface, etc. Non-exclusive examples of flooring-friendly material include rubber and expanded foam. A yielding material is any resilient material capable of being deformed or punctured. Non-exclusive examples of yielding material include silicone rubber, neoprene, or the like. A porous material is any material through which a spike element may be passed with little or no cutting of the material. Non-exclusive examples of porous material include felt and woven fibers. In one embodiment, the yielding material is silicone rubber and the flooring-friendly material is rubber having a greater shore A value than the shore A value of the silicone rubber.

The wrap 120 includes means for removably coupling the lower, intermediate, and upper layers 124, 126, 128 to the shoe 110, as shown in FIG. 5*a*. In one embodiment, the means for removably coupling the lower, intermediate, and upper layers 124, 126, 128 to the shoe 110 includes a first strap 132*a* extending from the cover side 123*a*, a second strap 132*b* extending from the cover side 123*b*, and a fastener 124 (FIG. 2) releasably coupling together the first and second straps 132*a*, 132*b*. The fastener 124 may be a hook and loop fastener (FIG. 2), laces, clasps, buckles, or any other appropriate coupling device.

The cover 122 may be configured to not extend lowerly adjacent the shoe sole rearward portion 112*b* when the cover 122 is lowerly adjacent the shoe sole forward portion 112*a* and the lower, intermediate, and upper layers 124, 126, 128 are coupled to the shoe 110, as shown in FIG. 5*a*. In other words, in one embodiment the cover 122 does not extend lowerly adjacent the shoe sole rearward portion 112*b* when the cover 122 is lowerly adjacent the shoe sole forward portion 112*a* and the lower, intermediate, and upper layers 124, 126, 128 are coupled to the shoe 110. Such a configuration may increase the portability of the wrap 120 and/or provide other benefits.

Figure 6A:
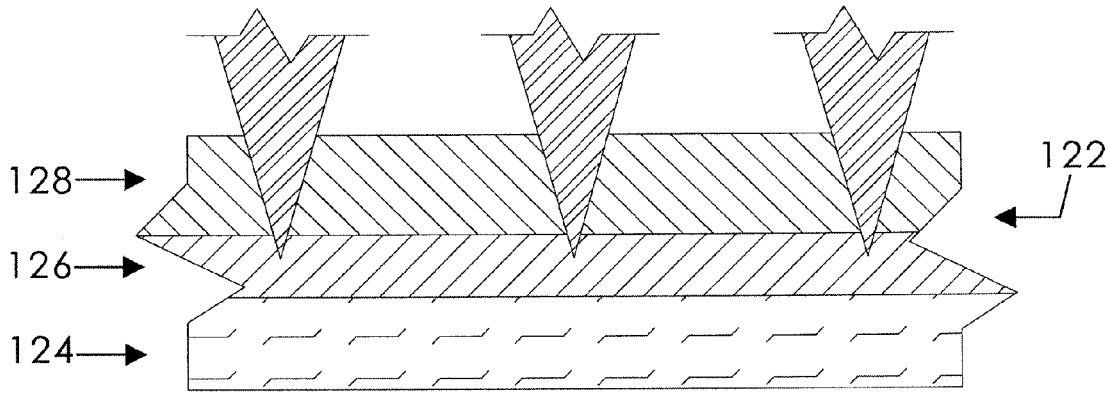
FIG. 6*a* is a plan view showing the spiked elements of the shoe interacting with the upper layer of the cover and partially with the intermediate layer.
Figure 6B:
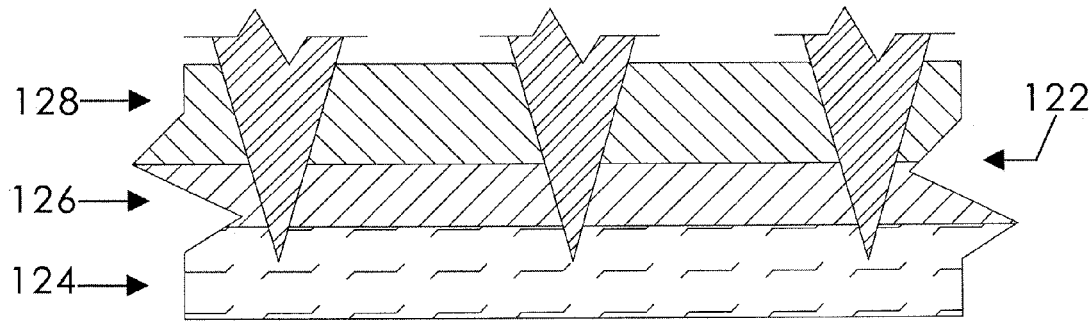
FIG. 6*b* is a plan view showing the spiked elements of the shoe interacting with the upper and intermediate layers of the cover and partially with the lower layer.

As shown in FIGS. 6*a* and 6*b*, when the cover 122 is lowerly adjacent the spike elements 114 and the lower, intermediate, and upper layers 124, 126, 128 are coupled to the shoe 110, the spike elements 114 interact with the upper layer 128 and at least a portion of the intermediate layer 126, and at least a portion of the lower layer 124 separates the spike elements 114 from a ground surface. The spike elements 114 may interact with a portion of the lower layer 124 (FIG. 6*b*), or the spike elements 114 may be completely separated from the lower layer 124 (FIG. 6*a*) so that the spike elements 114 and the lower layer 124 do not interact. Importantly, the spike elements 114 should not be able to extend through the lower layer 124 to the ground surface.

In use, the shoe 110 may be worn and used in a traditional manner to protect the wearer's foot and to provide traction when running. To avoid removing the shoe 110 between races to protect the ground surface from scratching, marring, or other damage and to protect the spike elements 114 from damage, the wrap 120 may be placed about the shoe 110 (FIGS. 5*a* and 5*b*). More particularly, the cover 122 may be placed lowerly adjacent the shoe sole 112, the straps 132*a*, 132*b* may be extended about the shoe 110, and the fastener 124 may couple together the straps 132*a*, 132*b* to secure the cover 122 to the shoe sole 112. As discussed above, coupling the wrap 120 to the shoe 110 causes the spike elements 114 to interact with the upper layer 128 and at least a portion of the intermediate layer 126, and at least a portion of the lower layer 124 separates the spike elements 114 from a ground surface (FIGS. 6*a* and 6*b*). In other words, the spike elements 114 pass through the upper layer 128, become embedded in the intermediate layer 126, and are separated from the ground surface by the lower layer 124. The user may then walk without fear of damaging the ground surface or the spike elements 114, and the treads 125 may provide traction. The sloped configuration of the rear section 124*b* of the ground-contact face 124*a* of the lower layer enables a person to walk smoothly as opposed to on their toes when the cover 122 is attached to a shoe. As repeated interaction with the spike elements 114 may fragment the intermediate layer 126, the upper layer 128 may be particularly useful in restricting portions of the intermediate layer 126 from passing through the upper layer 128 and separating from the lower layer 124.

It is understood that the shoe wrap 120 may include only a lower layer 124 and an upper layer 128 (alternative construction not shown). So long as the spike elements 114 are not too long, they will pass into and through the upper layer 128 and interact partially with the lower layer 124 while still being separated from a ground surface by the lower layer 128.

It is understood that while certain forms of this invention have been illustrated and described, it is not limited thereto except insofar as such limitations are included in the following claims and allowable functional equivalents thereof.

The invention claimed is:

1. A shoe system, comprising:

a shoe having a sole with forward and rearward portions, said forward portion having opposed sides and including a plurality of spike elements, said rearward portion being void of spike elements;

wherein said sole includes a front and a rear end, said sole forward portion and said sole rearward portion being integrally connected together generally at a midpoint between said front and rear end;

a cover configured to span laterally between said opposed sides of said forward portion; said cover having opposed sides and including a lower layer, an intermediate layer, and an upper layer lowerly adjacent said spike elements;

wherein said lower, intermediate, and upper layers of said cover extend between said sole front end and said midpoint between said sole front and rear ends;

wherein said cover does not extend between said sole rear portion rear end and said shoe sole midpoint when said cover is lowerly adjacent said shoe sole forward portion;

said lower layer includes a ground-contact face having a plurality of treads; and said ground contact face includes a rear section having a rearwardly upwardly sloped configuration so as to enhance walking smoothness when said cover is attached to said shoe sole forward portion;

wherein said ground contact face rear section is situated lowerly adjacent said sole midpoint between said sole front and rear ends;

means for removably coupling said lower, intermediate, and upper layers to said shoe;

wherein said intermediate layer is constructed of silicone rubber;

wherein said lower layer is constructed of rubber having a greater shore A value than a shore A value of the silicone rubber;

wherein said upper layer is constructed of porous material;

wherein said at least a portion of said intermediate layer and a portion of said lower layer are configured to interact with said spike elements when said cover is lowerly adjacent said spike elements; and wherein at least a portion of said lower layer is configured to separate said spike elements from a ground surface when said cover is lowerly adjacent said spike elements.

2. The shoe system of claim 1, wherein said upper layer is configured to restrict portions of said intermediate layer from passing therethrough.

3. The shoe system of claim 1, wherein said means for removably coupling said lower, intermediate, and upper layers to said shoe include:

a first strap extending from one said cover side;

a second strap extending from another said cover side; and a fastener releasably coupling together said first and second straps.

4. The shoe system of claim 3, wherein said fastener is a hook and loop fastener.

5. The shoe system of claim 1, wherein:

said lower layer includes a ground-contact face having a plurality of treads; and said ground contact face includes a rear section having a rearwardly upwardly sloped configuration so as to enhance walking smoothness when said cover is attached to said shoe sole forward portion.

6. The shoe system of claim 1, wherein:

said porous material is felt;

said yielding material is silicone rubber.

7. The shoe system of claim 6, wherein:

said upper layer restricts portions of said intermediate layer from passing therethrough;

said lower layer includes a ground-contact face having a plurality of treads; and said means for removably coupling said lower, intermediate, and upper layers to said shoe include:

a first strap extending from one said cover side;

a second strap extending from another said cover side; and a fastener releasably coupling together said first and second straps.

8. The shoe system of claim 1, wherein:

said upper layer restricts portions of said intermediate layer from passing therethrough;

said means for removably coupling said lower, intermediate, and upper layers to said shoe include:

a first strap extending from one said cover side;

a second strap extending from another said cover side; and a fastener releasably coupling together said first and second straps.

9. A shoe system, comprising:

a shoe having a sole with forward and rearward portions, said forward portion having opposed sides and including a plurality of spike elements, said rearward portion being void of spike elements;

wherein said sole includes a front and a rear end, said sole forward portion and said sole rearward portion being integrally connected together generally at a midpoint between said front and rear end;

a cover configured to span laterally between said opposed sides of said forward portion; said cover having opposed sides and including a lower layer, an intermediate layer, and an upper layer lowerly adjacent said spike elements;

wherein said cover includes opposed sides and includes a lower layer, an intermediate layer constructed of yielding material, and an upper layer constructed of porous material;

wherein said lower, intermediate, and upper layers of said cover extend between said sole front end and said midpoint between said sole front and rear ends;

wherein said cover does not extend lowerly adjacent said shoe sole rearward portion when said cover is lowerly adjacent said shoe sole forward portion;

said lower layer includes a ground-contact face having a plurality of treads; and said ground contact face includes a rear section includes a rearwardly upwardly sloped configuration adjacent said sole midpoint between said sole front and rear ends;

a first strap extending from one said cover side;

a second strap extending from another said cover side;

a fastener releasably coupling together said first and second straps to removably couple said lower, intermediate, and upper layers to said shoe;

wherein said spike elements interact with said upper layer and said intermediate layer when said cover is lowerly adjacent said spike elements; and wherein said lower layer separates said spike elements from a ground surface when said cover is lowerly adjacent said spike elements.

10. The shoe system of claim 9, wherein:

said porous material is felt;

said yielding material is silicone rubber;

said flooring-friendly material is rubber having a greater shore A value than a shore A value of the silicone rubber;

said upper layer restricts portions of said intermediate layer from passing therethrough.

* * * * *